US008925901B2

(12) United States Patent
Gaillard

(10) Patent No.: US 8,925,901 B2
(45) Date of Patent: Jan. 6, 2015

(54) CONTROL MEANS FOR A LIFTER DEVICE, HOIST APPARATUS, AND AN AIRCRAFT

(71) Applicant: Airbus Helicopters, Marignane, Cedex (FR)

(72) Inventor: Christophe Gaillard, La Roque d'Antheron (FR)

(73) Assignee: Airbus Helicopters, Marignane Cedex (FR)

( * ) Notice: Subject to any disclaimer, the term of this patent is extended or adjusted under 35 U.S.C. 154(b) by 0 days.

(21) Appl. No.: 13/654,622

(22) Filed: Oct. 18, 2012

(65) Prior Publication Data

US 2013/0105749 A1 May 2, 2013

(30) Foreign Application Priority Data

Oct. 27, 2011 (FR) ..... 11 03270

(51) Int. Cl.

| | |
|---|---|
| ***B66D 1/48*** | (2006.01) |
| ***B66D 1/42*** | (2006.01) |
| ***B66D 3/18*** | (2006.01) |
| ***B66D 1/60*** | (2006.01) |

(52) U.S. Cl.

CPC .. *B66D 1/42* (2013.01); *B66D 3/18* (2013.01); *B66D 1/60* (2013.01)

USPC ..... 254/270; 254/274; 254/275

(58) Field of Classification Search

USPC ..... 254/273–275, 269–271, 264

See application file for complete search history.

(56) References Cited

U.S. PATENT DOCUMENTS

| | | | | | |
|---|---|---|---|---|---|
| 2,989,288 | A | * | 6/1961 | Smith | 254/334 |
| 3,086,090 | A | * | 4/1963 | Carroll | 200/5 E |
| 3,260,508 | A | * | 7/1966 | Powell | 254/331 |
| 3,469,164 | A | * | 9/1969 | Smith et al. | 318/257 |
| 3,537,686 | A | * | 11/1970 | McKendrick | 254/264 |
| 3,548,272 | A | * | 12/1970 | Messmer | 212/285 |
| 3,654,415 | A | * | 4/1972 | Hawkins et al. | 200/302.3 |
| 3,755,725 | A | * | 8/1973 | Cordes | 318/257 |
| 3,758,079 | A | * | 9/1973 | Workman et al. | 254/360 |
| 3,933,388 | A | * | 1/1976 | Conboy | 294/185 |
| 3,998,432 | A | * | 12/1976 | Uldricks et al. | 254/386 |

(Continued)

FOREIGN PATENT DOCUMENTS

FR 1254845 A 2/1961

OTHER PUBLICATIONS

Search Report and Written Opinion; Application No. FR 1103270; dated May 10, 2012.

*Primary Examiner* — Emmanuel M Marcelo
*Assistant Examiner* — Michael Gallion
(74) *Attorney, Agent, or Firm* — Brooks Kushman P.C.

(57) ABSTRACT

The present invention relates to control means (20) for controlling a lifter device (10), the control means having a grip (25) comprising a body (30) extending longitudinally in a first direction (D1) in elevation from a first end (31) to a second end (32), said control means (20) including at least one control member (40) for controlling said lifter device (10). The body (30) includes a groove (33) extending longitudinally in a second direction (D2) in elevation, said groove (33) having a back wall (34) and an open section (35) that is open to the outside (EXT) of the grip (25) so that a suspension member (15) can be reversibly inserted in said groove (33) through said open section (35), the suspension member (15) being held in said groove (33) by the hand of an operator.

19 Claims, 4 Drawing Sheets

(56) References Cited

U.S. PATENT DOCUMENTS

| | | | | | |
|---|---|---|---|---|---|
| 4,118,012 | A * | 10/1978 | Kerr et al. | 254/269 |
| 4,243,060 | A * | 1/1981 | McKendrick | 137/625.69 |
| 4,557,659 | A * | 12/1985 | Scaglia | 414/627 |
| 4,844,421 | A * | 7/1989 | Kojima | 254/270 |
| 4,883,146 | A * | 11/1989 | Varner et al. | 182/5 |
| 5,070,962 | A * | 12/1991 | Varner | 182/7 |
| 5,131,491 | A * | 7/1992 | Varner et al. | 182/7 |
| 5,143,505 | A * | 9/1992 | Burdea et al. | 414/5 |
| 5,707,094 | A * | 1/1998 | Gower | 294/65 |
| 5,772,184 | A * | 6/1998 | Zaguroli, Jr. | 254/361 |
| 5,850,928 | A * | 12/1998 | Kahlman et al. | 212/285 |
| 6,299,139 | B1 * | 10/2001 | Kazerooni | 254/270 |
| 6,634,621 | B2 * | 10/2003 | Keith | 254/270 |
| 6,681,638 | B2 * | 1/2004 | Kazerooni et al. | 73/760 |
| 6,738,691 | B1 * | 5/2004 | Colgate et al. | 700/245 |
| 6,814,185 | B1 * | 11/2004 | Ostrobrod | 182/193 |
| 6,886,812 | B2 * | 5/2005 | Kazerooni | 254/270 |
| 6,916,015 | B2 * | 7/2005 | Andreasson | 254/270 |
| 7,131,515 | B2 * | 11/2006 | Gartsbeyn et al. | 182/192 |
| 7,137,481 | B2 * | 11/2006 | Petzl et al. | 182/192 |
| D543,334 | S * | 5/2007 | Helmetsie | D34/35 |
| 7,226,038 | B1 * | 6/2007 | Wickstrom | 254/276 |
| 7,810,791 | B2 * | 10/2010 | DeVos | 254/270 |
| 7,856,930 | B2 * | 12/2010 | Zaguroli, Jr. | 105/29.1 |
| 8,157,113 | B2 * | 4/2012 | Golder | 212/284 |
| 2003/0025802 | A1 * | 2/2003 | Mayer et al. | 348/211.99 |
| 2003/0057408 | A1 * | 3/2003 | Kazerooni et al. | 254/270 |
| 2004/0231923 | A1 * | 11/2004 | Gartsbeyn et al. | 182/192 |
| 2005/0205356 | A1 * | 9/2005 | Velasco | 182/3 |
| 2006/0226106 | A1 * | 10/2006 | Zaguroli | 212/331 |
| 2008/0128668 | A1 * | 6/2008 | Fofonoff et al. | 254/334 |
| 2008/0157042 | A1 * | 7/2008 | Jacobson et al. | 254/270 |
| 2008/0224110 | A1 * | 9/2008 | Starks et al. | 254/264 |

* cited by examiner

Fig.3
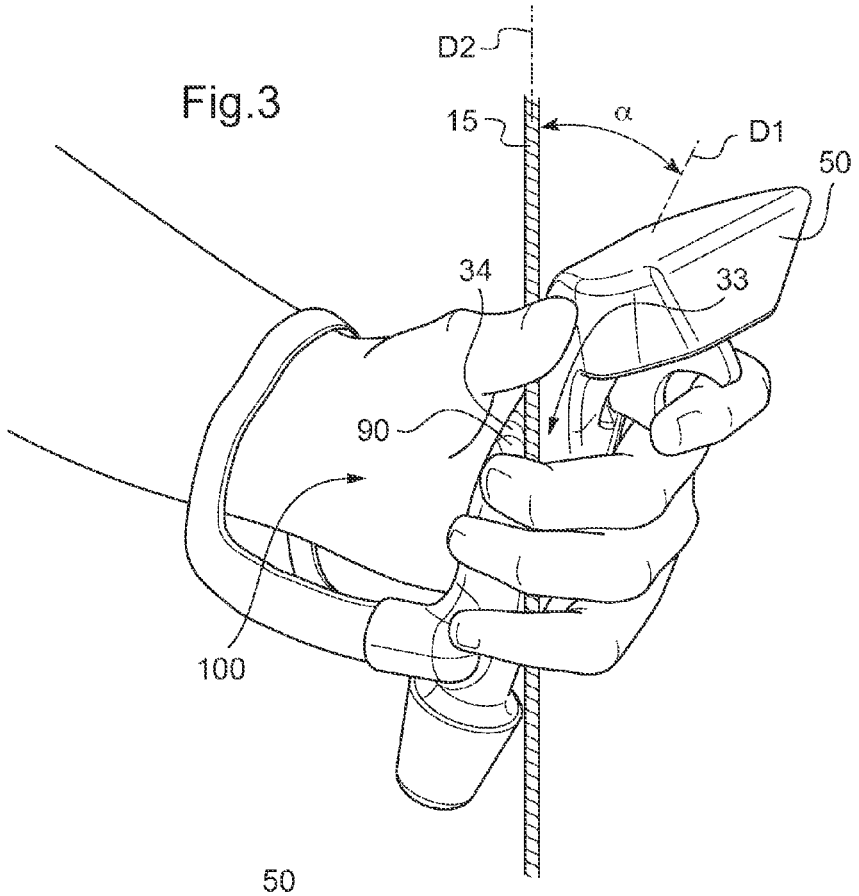
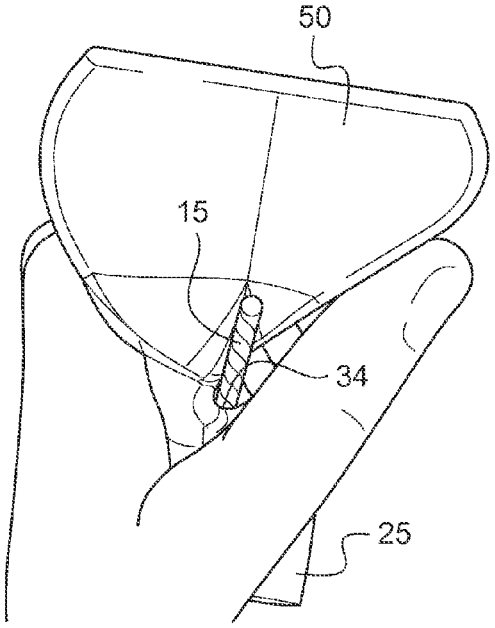
Fig.4

EXT

CONTROL MEANS FOR A LIFTER DEVICE, HOIST APPARATUS, AND AN AIRCRAFT

CROSS REFERENCE TO RELATED APPLICATIONS

This application claims priority to French patent application No. FR 11 03270 filed on Oct. 27, 2011, the disclosure of which is incorporated in its entirety by reference herein.

BACKGROUND OF THE INVENTION (1) Field of the Invention

The present invention relates to means for controlling a lifter device, to hoist apparatus, and to an aircraft.

The technical field of the invention is thus the field of devices for hoisting a load that is outside an aircraft.

(2) Description of Related Art

An aircraft, and more particularly a rotorcraft of the helicopter type, may be fitted in optional manner with an installation for transporting external loads.

Such a hoist apparatus may comprise a lifter device capable of lowering or raising a suspension member relative to the fuselage of the aircraft, the suspension member possibly comprising a hoist cable or a hoist chain, for example.

Such a lifter device is commonly referred to as a "winch" by the person skilled in the art. A lifter device conventionally includes a motor that rotates a reel having the suspension member wound thereon.

A hoist apparatus also includes control means for controlling the lifter device. The control means include a grip and at least one control panel.

The control panel may have control members for controlling movement of the suspension member, or indeed for controlling a hook device arranged at the free end of the suspension member. In addition, the control panel may include an indicator for indicating the length of the suspension member that has been deployed from the lifter device, a control button for controlling a beam carrying the lifter device or deflector means of the hoist apparatus, a system for controlling the aircraft, means for shearing the suspension member, and possibly also means for communicating with the aircraft cockpit.

The term "control member" is used to cover any means present on control means for controlling a hoist device.

Under such circumstances, the control means are often fastened to the structure of the aircraft.

An operator, conventionally referred to as a winch operator, holds the control means in one hand and the suspension member in the other hand.

The operator holds the suspension member in order to guide it.

Furthermore, by holding the suspension member, the operator can evaluate the tension exerted on the suspension member in order to determine whether any load suspended from the suspension member is or is not resting on the ground. It is difficult for the operator to assess distances, since such distances are distorted by the aircraft being vertically above the ground.

The state of the art includes document EP 0 120 995 which describes a hoist apparatus having a lifter device co-operating with a suspension member, and a control device connected by a cable to the lifter device.

The control device comprises a unit having a body and handle means. The body then has a longitudinal slot associated with closure means, the slot being open to receive the suspension member and then being closed once the suspension member has been inserted in the slot.

Document U.S. Pat. No. 3,755,725 describes a hoist device having a lifter device connected to a grip, the grip also being connected to a hook.

The following documents are also known: US 2006/226106; FR 1 254 845; and US 2003/057408.

BRIEF SUMMARY OF THE INVENTION

An object of the present invention is thus to provide control means for controlling a hoist device of an aircraft and enabling safety of an operator to be optimized without disturbing control over a winching operation.

According to the invention, control means for controlling a lifter device are provided with a grip for holding in the hand, the grip comprising a body extending longitudinally in a first direction in elevation from a first end to a second end, the control means including at least one control member for controlling the lifter device.

The control means may in particular have control members including members for controlling movement of the suspension member or indeed for controlling a hook device arranged at the free end of the suspension member, an indicator for indicating the length of the suspension member, means for controlling a beam carrying the lifter device or deflector means of the apparatus, means for shearing the suspension member, a system for controlling the aircraft, or indeed means for communicating with the aircraft cockpit.

The control means are also remarkable in particular in that the body includes a groove extending longitudinally in a second direction in elevation, the groove having a back wall and an open section that is open to the outside of the grip so that a suspension member carried by the lifter device can be reversibly inserted in said groove through said open section while allowing the suspension member to slide relative to the grip, the suspension member being held in said groove by the hand of an operator.

Under such circumstances, a suspension member, in particular such as a hoist cable or chain, may be inserted in an open groove of the grip. The control means then comprise a grip containing a blind recess capable of receiving a suspension member, and not a body provided with a slot that is associated with closure means of the type described in document EP 0 120 995.

The invention thus provides control means capable of guiding the suspension member and of controlling a hoist device.

In order to perform a winching operation, an operator takes hold of the control means. The operator then places the control means on the suspension member, the suspension member being capable of sliding in the grip.

The operator may then hold the grip in a first hand, the first hand preventing the suspension member from escaping from the groove in the grip. Thus, while using this first hand, the operator can both manipulate the control members of the control means, and can also guide the suspension member in a plane while using the first hand via the control means.

It should be observed that the first hand is also relatively well protected by the control means. If the suspension member presents metal splinters as a result of wear, any risk of contact between such splinters and the first hand is minimized insofar as the operator does not apply direct force against the suspension member.

Using this first hand on its own, the operator can thus control the lifter device and guide the suspension member manually. An operator is then not disturbed by using such control means insofar as the operator continues to hold the suspension member with one hand.

The operator can thus hold onto the aircraft with the other hand in order to keep in a safe position. The other hand may serve solely to keep the operator in place on the aircraft, and is therefore not used for controlling the lifter device.

It should be observed that since the operator is holding onto the aircraft with the other hand, the operator can also guide the suspension member with the first hand with maximized force and agility.

Finally, the operator can easily and quickly separate the control means from the suspension member, since the open section is closed only by a portion of the operator's first hand. Opening the hand in part enables the suspension member to be extracted from the groove, or enables the suspension member to be caused to penetrate into the groove.

In another aspect, it can be understood that the control means may include wired or wireless connection means connected to the various controlled elements, and in particular to the lifter device.

The control means may also possesses one or more of the following additional characteristics.

For example, the back wall of the groove may face the palm of an operator's hand, with the fingers of said hand covering the groove at least in part, and more particularly the open section of said groove.

In another aspect, the control means optionally include a control panel secured to the second end of the grip, the control panel carrying at least one control member.

In a first variant, the open section is rectilinear. It is then easy to insert the suspension member in the groove.

In a second variant, the open section is curved. It is then more difficult to make the suspension member penetrate into the groove, since the operator needs to perform a particular movement in order to enable the suspension member to be arranged within the grip. However, it should be observed that it is easier to keep the suspension member in this groove.

In a first embodiment, the first direction is parallel to the second direction.

In a second embodiment, the first direction presents an acute angle relative to the second direction. It is then found to be easier to exert a force on the suspension member.

Furthermore, the control means may include a removable trough defining the groove.

Such a trough may optionally be made of a polymer material having a low coefficient of friction and good mechanical strength, such as a material known under the name polyoxymethylene (or polyformaldehyde) or by the initials POM or the trademark Teflon®.

The trough is then a wear part that may be changed without requiring the entire control means to be discarded.

In another aspect, the control means include connection means for connecting the grip to an operator's arm, such as at least one loop or strap. During particular operations, the operator can thus let go of the control means.

In addition to providing control means, the invention also provides a hoist device provided with a lifter device cooperating with a suspension member, the hoist device having control means for controlling the lifter device, the control means comprising a grip for holding in the hand, the grip comprising a body extending longitudinally in a first direction in elevation from a first end to a second end, the control means including at least one control member for controlling said lifter device.

The control means are then of the above-described type.

Finally, the invention also provides an aircraft including such a hoist device.

BRIEF DESCRIPTION OF THE SEVERAL VIEWS OF THE DRAWINGS

The invention and its advantages appear in greater detail from the following description of embodiments given by way of illustration and with reference to the accompanying figures, in which:

FIGS. 3 to 5 are views of control means in a second embodiment and engaged around a suspension member;

Elements that are present in more than one of the figures are given the same references in each of them.

DETAILED DESCRIPTION OF THE INVENTION

Figure 1:
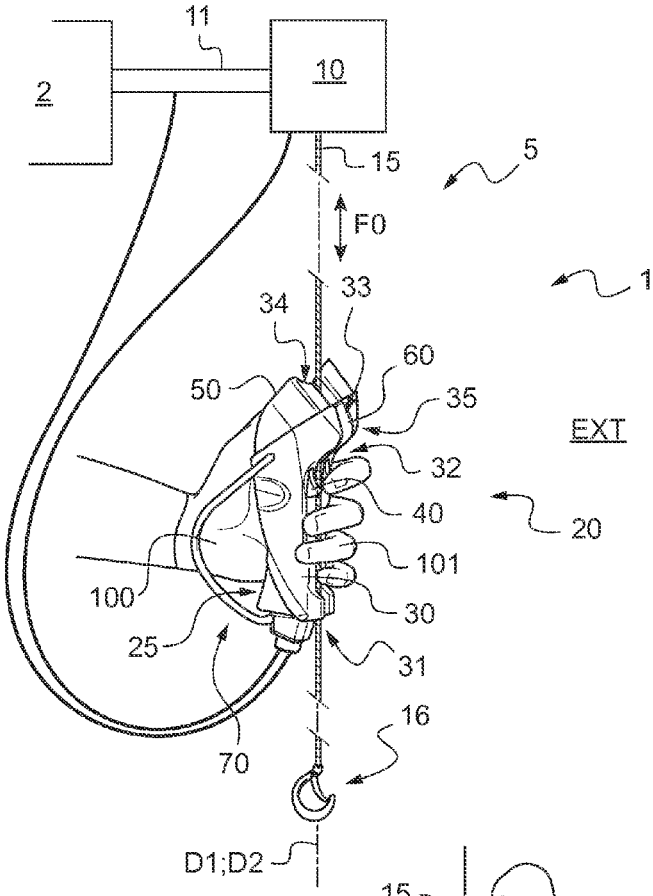
FIG. 1 is a diagram of an aircraft in a first embodiment of the invention.

FIG. 1 shows an aircraft 1 having a fuselage 2 and a hoist device 5. Such an aircraft may be a rotary wing aircraft.

Under such circumstances, the hoist device 5 comprises a suspension member 15 such as a hoisting cable or chain. The suspension member 15 then extends under gravity from a lifter device 10 to hook means 16. For example, the hoist device 5 may include a hoist cable 15 carrying a release hook 16, the hoist cable 15 being wound on a winch 10.

In addition, the lifter device may be fastened to the fuselage 2 by a support beam 11 that may optionally be movable.

Furthermore, the hoist device 5 includes control means 20 having at least one control member suitable for controlling the various active elements of the device, specifically the hook means 16, the lifter device 10, and the beam 11, for example.

The control means 20 include a grip 25. The grip possesses a body 30 that may be held in the hand of an operator, and that may well be shaped to match a human hand.

The body 30 then extends in elevation in a first direction D1 from a first end 31 towards a second end 32. Control members 40 for controlling the hoist device may then be fastened to the body 30, or to a control panel 50 secured to the second end 32.

The control members may be connected by wired connections to the relevant elements as in the example shown diagrammatically, however it is also possible to envisage using wireless connections.

Furthermore, the body 30 may include a groove 33 extending longitudinally in elevation in a second direction D2. The groove 33 may optionally be formed in the control panel 50.

The groove 33 also extends in a transverse plane from a back wall 34 towards a section 35 that is transversely open to the outside EXT. Under such circumstances, it is possible to cause an item to penetrate into the groove 33, and in particular the suspension member 15.

The suspension member may be inserted in the groove independently of the position of the hook member, and regardless of the items carried by the hook member.

The operator's palm 100 then comes into abutment against a portion of the body 30 acting as the back wall 34, and advantageously shaped to match the shape of the palm. Conversely, the operator's fingers 101 close over the groove 33, the fingers 101 covering the groove at least in part when the operator grips the grip 25.

It can be understood that the suspension member can slide in the groove 33 under gravity as shown by arrows F0, the suspension member being held in the groove in particular by the operator's fingers. It can also be seen that the second direction is in the gravity direction when the grip 25 is arranged on the suspension member.

Furthermore, it can be seen that the grip may include a replaceable trough 60 defining the groove 33. The trough may thus have U-shaped sections.

Figure 2:
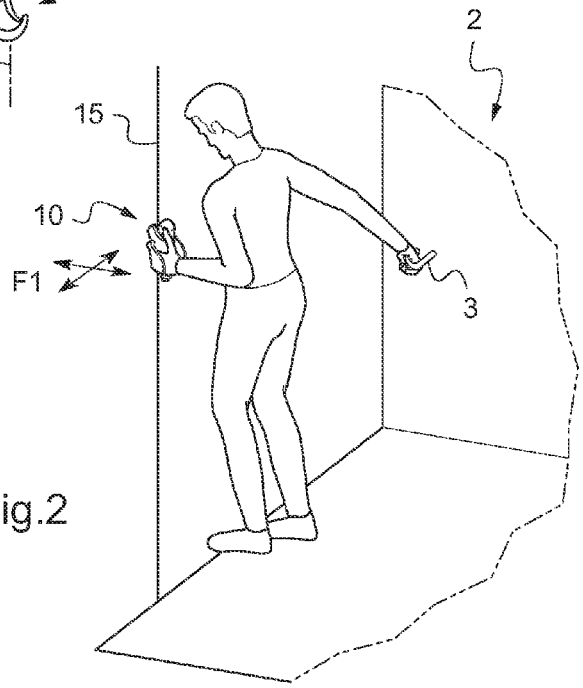
FIG. 2 is a diagram showing an operator during a winching operation.

With reference to FIG. 2, in order to perform a winching operation, an operator places the control means on the suspension member 15, the suspension member being engaged in the groove 33 of the control means.

The operator can thus use a first hand firstly for controlling the hoist device by using the control means 20, and secondly for guiding and moving the suspension member 15 along double-headed arrows F1. Consequently, the operator can then also use the other hand to hold tight to handle means 3 of the aircraft.

FIG. 1 shows a first embodiment of the control means 20.

In this first embodiment, the first direction D1 is parallel to the second direction D2, and may coincide with the second direction D2.

Furthermore, the open section may be rectilinear in order to make it easier to place the suspension member in the groove 33.

Figure 7:
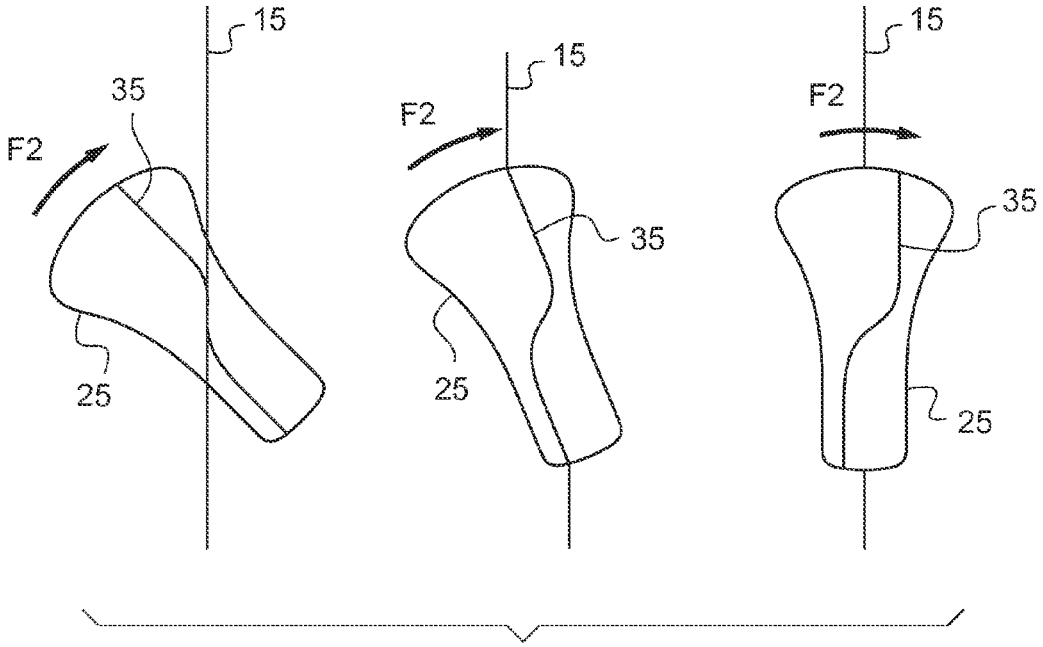
FIG. 7 is a diagram showing a curved open section.

In another variant shown in FIG. 7, the open section 35 may be curved, e.g. presenting an S-shaped portion that requires the wrist to be turned as shown by arrows F2 in order to insert the suspension member in the groove 33.

In the second embodiment of FIG. 3, the first direction D1 is at an acute angle $\alpha$ relative to the second direction D2.

In addition, it can be seen that the portion of the grip in contact with the operator's palm 100 may be shaped to match the shape of the palm, this portion also defining the back wall 34 of the groove 33.

This portion may also include a thumb support 90 for supporting the thumb of the first hand that is holding the grip. The thumb may come directly into contact with the suspension member 15.

Furthermore, the inlet section of the groove may be rectilinear or curved.

Figure 5:
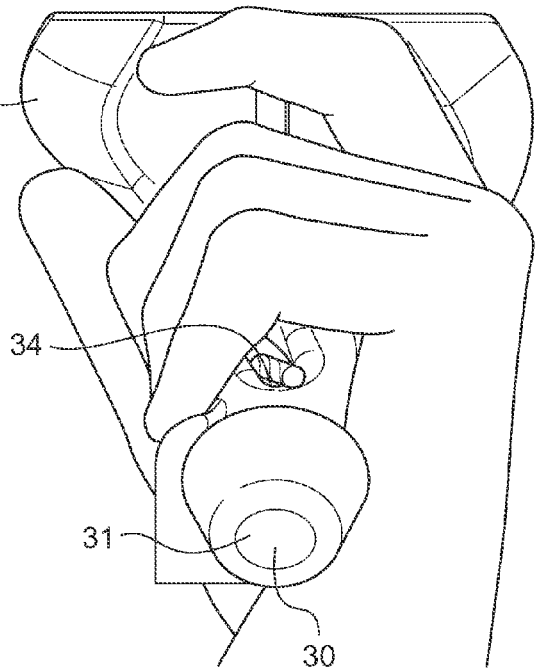

In addition, with reference to FIGS. 4 and 5, the back wall 34 may be curved, it also being possible for the back wall to be rectilinear.

Figure 6:
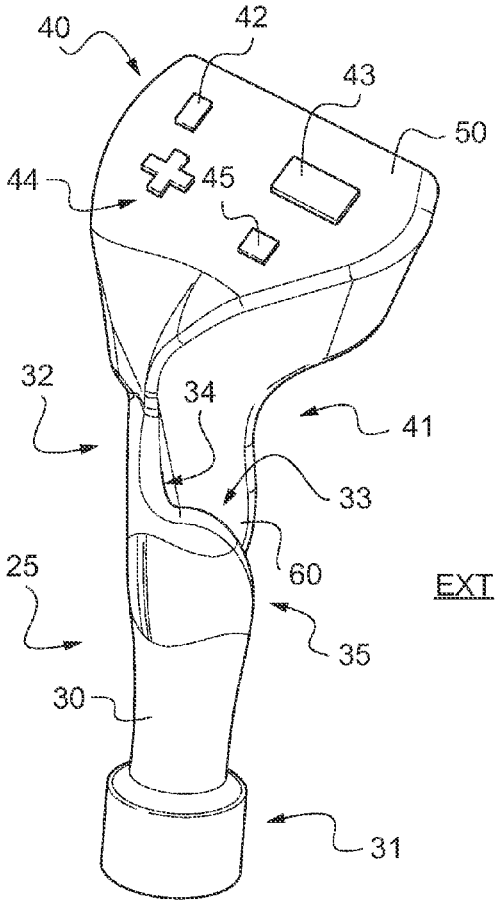
FIG. 6 is a diagram of control means in a second embodiment.

FIG. 6 is a view of the control means 20 in the second embodiment.

Independently of the embodiment, it should be observed that the control means may include a plurality of control members 40, e.g. arranged on the control panel 50.

In particular, the control members may include:

an indicator 43 for indicating the length of the suspension member that is deployed out from the lifter device;

a control button 42 for controlling the beam 11 carrying the lifter device 10, or deflector means of the apparatus;

a joypad button 44 for controlling the aircraft, e.g. by co-operating with an autopilot device of the aircraft;

communications means 45 for communicating with the aircraft cockpit;

means for shearing the suspension member; and a control button 41 for controlling the lifter device, e.g. a button of the trigger type.

Furthermore, with reference to FIGS. 1, 2, and 3, the control means may include connection means 70 for connecting the control means to the operator's arm, such as loops or a strap, for example.

Naturally, the present invention may be subjected to numerous variations as to its implementation. Although several embodiments are described above, it will readily be understood that it is not conceivable to identify exhaustively all possible embodiments. It is naturally possible to envisage replacing any of the means described by equivalent means without going beyond the ambit of the present invention.

What is claimed is:

1. A hoist device comprising:

a lifter device co-operating with a suspension member;

a control means located remotely from the lifter device for remotely controlling by an operator the lifter device lowering and raising of the suspension member, the control means including:

a grip for holding in an operator's hand, the grip comprising a solid body extending longitudinally in a first direction in elevation from a first end to a second end;

a groove formed in the solid body and extending longitudinally in a second direction in elevation, said groove having a depth extending in a transverse direction from a back wall towards an opening transversally open to the outside of the grip so that a suspension member carried by the lifter device can be reversibly inserted in the groove through the opening while allowing the suspension member to slide relative to the grip, the suspension member being held in the groove by the operator's hand; and a control panel positioned on the grip, the control panel carrying at least one control member for remotely providing control signals to the lifter device.

2. The hoist according to claim 1, wherein the back wall faces a palm of the operator's hand, with fingers of the operator's hand covering the groove at least in part.

3. The hoist according to claim 1, wherein the groove is rectilinear.

4. The hoist device according to claim 1, wherein the groove is curved.

5. The hoist device according to claim 1, wherein the first direction is parallel to said second direction.

6. The hoist device according to claim 1, wherein the first direction presents an acute angle relative to the second direction.

7. The hoist device according to claim 1, including a removable trough defining said groove.

8. The hoist device according to claim 1, including connection means for connecting the grip to an operator's arm.

9. An aircraft, including a hoist device according to claim 1.

10. A hoist comprising:

a winch co-operating with a suspension member;

a hand-held controller located remotely from the winch for remotely controlling by an operator lowering and raising of the suspension member by the winch, the controller including:

a grip body for holding in an operator's hand; and a groove formed in the grip body and extending along a longitudinal direction and the groove having a depth extending in a transverse direction from a back wall towards an opening transversally open to the outside of the grip so that a suspension member carried by the winch can be reversibly inserted in the groove while allowing the suspension member to slide relative to the grip body.

11. The hoist according to claim 10, wherein the back wall is closed and faces a palm of the operator's hand and wherein, with fingers of the operator's hand at least in part covers the opening when in use.

12. The hoist according to claim 10, including connection means for connecting the grip to an operator's arm.

13. The hoist according to claim 10, wherein the groove is a blind recess.

14. The hoist according to claim 10, wherein the groove is U-shaped.

15. The hoist according to claim 1, wherein the groove is a blind recess.

16. A controller for a lifter device, the controller comprising:

a grip body having a solid core for holding in an operator's hand;

a groove formed in formed in the solid core of the grip body and extending lengthwise along a length of the grip body in a longitudinal direction and the groove having a depth extending in a transverse direction from a back wall towards an opening transversally open to the outside of the grip so that a suspension member carried by the lifter device can be reversibly inserted in the groove while allowing the suspension member to slide relative to the grip body, and at least one a control button positioned on the grip for remotely providing control signals to the lifter device for raising and lowering the suspension member.

17. The controller according to claim 16, wherein the groove is a blind recess having a U-shape.

18. The hoist according to claim 10, further comprising at least one a control button positioned on the grip for remotely providing control signals to the winch for raising and lowering the suspension member.

19. The hoist according to claim 10, wherein the grip includes a solid core and the groove is formed solid core such that a back was of the groove is defined by the solid core.

* * * * *